US006572000B2

(12) United States Patent
Hirai et al.

(10) Patent No.: US 6,572,000 B2
(45) Date of Patent: Jun. 3, 2003

(54) DRIVING TOOL

(75) Inventors: Shoichi Hirai, Ibaraki (JP); Akira Uno, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/727,493

(22) Filed: Dec. 4, 2000

(65) Prior Publication Data

US 2001/0004084 A1 Jun. 21, 2001

(30) Foreign Application Priority Data

Dec. 3, 1999 (JP) ..... 11-344298
Dec. 3, 1999 (JP) ..... 11-344304
Dec. 3, 1999 (JP) ..... 11-344305

(51) Int. Cl.[7] ..... B25C 1/04
(52) U.S. Cl. ..... 227/130; 227/142
(58) Field of Search ..... 227/8, 130, 156, 227/206, 208, 142

(56) References Cited

U.S. PATENT DOCUMENTS 4,211,352 A * 7/1980 Zilka ..... 227/130
4,907,730 A * 3/1990 Dion ..... 227/130
5,259,465 A * 11/1993 Mukoyama ..... 173/168
5,562,240 A * 10/1996 Campbell ..... 173/20
5,667,127 A * 9/1997 Ichikawa et al. ..... 227/142
5,850,961 A * 12/1998 Braun et al. ..... 227/130
5,878,936 A * 3/1999 Adachi et al. ..... 227/130
5,918,788 A * 7/1999 Moorman et al. ..... 227/130
6,179,192 B1 * 1/2001 Weinger et al. ..... 173/171

FOREIGN PATENT DOCUMENTS

JP 10-109280 4/1998 ..... B25C/7/00

* cited by examiner

*Primary Examiner*—Scott A. Smith
*Assistant Examiner*—Nathaniel Chukwurah
(74) *Attorney, Agent, or Firm*—Sughrue Mion, PLLC

(57) ABSTRACT

In a driving tool, an air tank 103 is coupled via a pressure reducing valve 104 to a rear end of a handle portion 102 which is disposed substantially perpendicularly to an approximately cylindrical output section 101, and the air tank 103 is configured by: a vertical portion 103*a* which protrudes in the rear side of the handle section 102; and a horizontal portion 103*b* which extends in substantially parallel with the handle section 102, whereby the center of gravity 140 of the whole tool is positioned in the vicinity of a gripping portion 130, so that the weight balance is improved and the dimensions are reduced.

16 Claims, 13 Drawing Sheets

DRIVING TOOL

BACKGROUND OF THE INVENTION

1. Field of the Invention

The present invention relates to a hoseless driving tool in which compressed air of a pressure that is higher than the working pressure of an output section is stored in an air tank coupled to the tool body, and the high pressure compressed air in the air tank is supplied to the output section with reducing the pressure by a pressure reducing valve, to operate the output section, thereby driving a fastener such as a nail.

2. Description of the Related Art

The assignee of the present invention has proposed in Japanese patent application No. HEI11-73400 (U.S. Ser. No. 09/527,303) a hoseless driving tool in which an air tank for storing compressed air at a pressure that is higher than a pressure at which an output section is operable is attached to the body of the driving tool, and the high pressure compressed air in the air tank is supplied to an output section with reducing the pressure to operate the output section, thereby driving a fastener.

As compared with a conventional driving tool which is operated by supplying compressed air from an external compressed air source via an air hose or the like, the proposed hoseless driving tool has an advantage that the workability is excellent because the use of the tool is enabled without dragging an air hose and is not restricted by the place where an external compressed air source is disposed.

However, the attachment of the air tank, a pressure reducing valve, and the like causes the dimensions and the weight of the tool to be increased. In order to store compressed air at a pressure that is higher than the air pressure at which the output section is operable, particularly, the air tank must have a shell which is thicker than the output section. Depending on the arrangement of the air tank and the pressure reducing valve, therefore, the tool may difficult to use in a confined place, or the weight balance of the whole tool may be impaired. As a result the workability is sometimes lowered.

As shown in FIG. 1, for example, a pressure reducing valve 104 and a long air tank 103 may be arranged in series with starting from the rear end of a handle section 102, and on a line extended from the axis 170 of the handle section 102. In this case, the total length is so long that the tool is hardly used in a confined place. Since the air tank 103 which is heavy is remote from a gripping portion of the handle section 102, the center of gravity 140 of the whole driving tool is positioned behind the handle section 102. When the handle section 102 is gripped to hold the body, the moment acting on the hand is M•L where M is the weight of the tool body and L is the distance between the center 131 of the gripping portion 130 and the center of gravity 140. In the case of FIG. 1, the distance L is long, and therefore a large moment of gravity acts on the hand to impair the weight balance of the whole body, thereby producing problems such as that a large force is required for holding the driving tool in the direction to the target.

FIG. 2 is a front view of an example in which the air tank 103 is attached to another position. A plane 120 includes the axis 160 of an output section 101 and the axis 170 of the handle section 102. The air tank 103 has a shape in which the left side in the figure with respect of the plane 120 is larger. The air tank 103 causes the center of gravity 140 of the whole driving tool to be shifted from the plane 120 to the left side in the figure. According to this configuration, when the handle section 102 is gripped and the body is lifted by gripping the handle section 102, the body turns about the axis 170 of the handle section 102 so that the center of gravity 140 is positioned vertically below the handle section 102. Therefore, a nose 107 located above the axis 160 of the output section is directed obliquely downward, and hence it is difficult to aim the nose 107 at the driving position (FIG. 3). During a driving operation, a reaction 190 occurs in the direction toward the axis 160 of the output section, and the body tries to turn about the center of gravity 140. As shown in FIG. 4, when the center of gravity is positioned to be separated from the plane 120, rotation about the axis 170 of the handle section 102 is caused so that the body is tilted. As a result, a fastener 108 is driven while being bent, or a driver blade 109 is disengaged from the fastener 108 to strike a material to be fastened 150, so that the member 150 is easily damaged.

FIG. 5 shows a driving tool which has been proposed by the assignee of the present invention in Japanese Patent application No. HEI11-73400 (U.S. Pat. No. 6,220,496). In the driving tool, a piston 8 which is disposed in a cylinder 4 to be vertically moveable is driven by compressed air in a first accumulator chamber 2 disposed in the tool body 1, so that a fastener 6 is driven by a drive bit 7. A second accumulator chamber 20 is disposed which can store compressed air at a pressure that is higher than a pressure at which the tool body 1 is operable. The driving tool comprises: an air intake 16 which is connectable with an air compressor via an air hose or the like; a communication control valve 22 which controls communication between the second accumulator chamber 20 and the air intake 16; and a pressure reducing valve 21 through which the compressed air in the second accumulator chamber 20 is supplied to the first accumulator chamber 2 while reducing the pressure of the compressed air. The driving tool can be used without being connected with an air compressor via an air hose or the like. Consequently, the driving tool has features that the driving tool is free from cumbersome handling of an air hose and hence has excellent workability, and that the filling of compressed air can be easily performed. Also a configuration in which a discharge value through which, after the driving tool is used, the compressed air in the second accumulator chamber 20 is discharged is disclosed.

FIG. 6 shows a driving tool which has been proposed by the assignee in JP-A-10-109280. In the driving tool, an air duster mechanism is incorporated into the driving tool, so that a cleaning work of blowing wood chips and the like by the air duster and a driving operation by the driving tool are performed by one tool. The driving tool is used in a state where an air hose is connected with the driving tool, and therefore cannot be used without connecting an air hose.

Since compressed air is accumulated in the tool body as described above, the driving tool of FIG. 5 is preferably structured so that, after a driving work is ended, the compressed air in the tool body can be easily discharged to the atmosphere, and also that, after the driving work, a discharge valve can be operated as far as possible to completely discharge the compressed air from the tool body.

The driving tool shown in FIG. 6 incorporates the air duster mechanism, and therefore is very convenient for use. However, the driving tool cannot be used without connecting an air hose, and is restricted by the length of the air hose and the place where a compressed air source is disposed. Therefore, the driving tool has a disadvantage that the workability is poor. In the cleaning work by the air duster, particularly, the tool must be used with directing a nozzle to various directions in accordance with cleaning places, and hence it is cumbersome to handle the air hose.

Also, the above-mentioned driving tool shown in FIG. 5 is driven by the compressed air accumulated in the second accumulator chamber 20. Therefore, the driving tool can be used without being connected with an air compressor via an air hose or the like. Consequently, the driving tool has features that the driving tool is free from cumbersome handling of an air hose. When the driving operation is repeatedly performed, the compressed air in the second accumulator chamber 20 is consumed, and the pressure of the chamber is lowered. When the pressure is lower than the minimum pressure at which the tool body 1 can be driven, a driving failure such as that a fastener cannot be completely driven occurs, and finally the tool body 1 cannot be operated. When the driving tool is to be continuously used, therefore, it is required to refill the second accumulator chamber 20 with compressed air before the pressure of the second accumulator chamber 20 becomes lower than the minimum pressure at which the tool body 1 can be driven. In order to know the degree at which compressed air is accumulated in the second accumulator chamber 20, however, it is required to actually perform a driving operation and then judge whether the driving operation has been correctly performed or not. After the driving tool is used, it is preferable to discharge all compressed air in the second accumulator chamber 20 so as to make the chamber empty. In order to check whether the second accumulator chamber 20 is empty or not, it is required to perform a driving operation.

SUMMARY OF THE INVENTION

The invention has been made to solve the above problems with the prior art, and therefore an object of the present invention is to improve the arrangement of an output section, a handle section, and an air tank so as to reduce the dimensions, and to improve the weight balance so as to attain an enhanced workability.

Another object of the invention is to provide a driving tool which can eliminate the disadvantages of the driving tool having a second accumulator chamber, and that having an air duster, which can be simply configured, and which can be easily operated.

Still another object of the invention to provide a driving tool in which, even when a driving operation is not performed, the amount of compressed air in a second accumulator chamber can be easily known, so that a driving failure due to an insufficient pressure of the second accumulator chamber can be prevented from occurring and it is possible to easily check whether the second accumulator chamber is empty or not.

The above one object is attained by disposing an air tank behind a handle section, so that the center of gravity of the whole of a driving tool is positioned in the vicinity of a gripping portion of the handle section.

The one object is attained also by positioning an air tank and a pressure reducing valve so that, with respect to two regions which are separated from each other by a plane including axes of a handle section and an output section, a moment of gravity of a member(s) which is on a side of the axis of the handle section is substantially equal to a moment of gravity of a member(s) which is on another side of the axis, whereby a center of gravity of a whole of a driving tool is positioned in a vicinity of the plane.

The above another object is attained by a driving tool comprising: a first accumulator chamber which is disposed in a tool body; a second accumulator chamber in which compressed air can be accumulated, a pressure of the compressed air being higher than a pressure at which the tool body is operable; an air intake which is connectable with an air compressor via an air hose or the like; a communication control valve which controls communication between the second accumulator chamber and the air intake; and a pressure reducing valve through which the compressed air in the second accumulator chamber is supplied to the first accumulator chamber with reducing the pressure of the compressed air, a piston which is disposed in a cylinder to be vertically movable being driven by the compressed air in the first accumulator chamber, a fastener being driven by a drive bit attached to the piston, wherein a nozzle having an opening through which the compressed air is to be discharged, an air passage through which the nozzle communicates with the first accumulator chamber or the second accumulator chamber, and a discharge valve which controls discharging of the compressed air from the nozzle are operably disposed.

The above still another object is attained by providing a second accumulator chamber with a pressure gauge which measures the pressure of the second accumulator chamber.

DETAILED DESCRIPTION OF THE PREFERRED EMBODIMENTS

Figure 1:
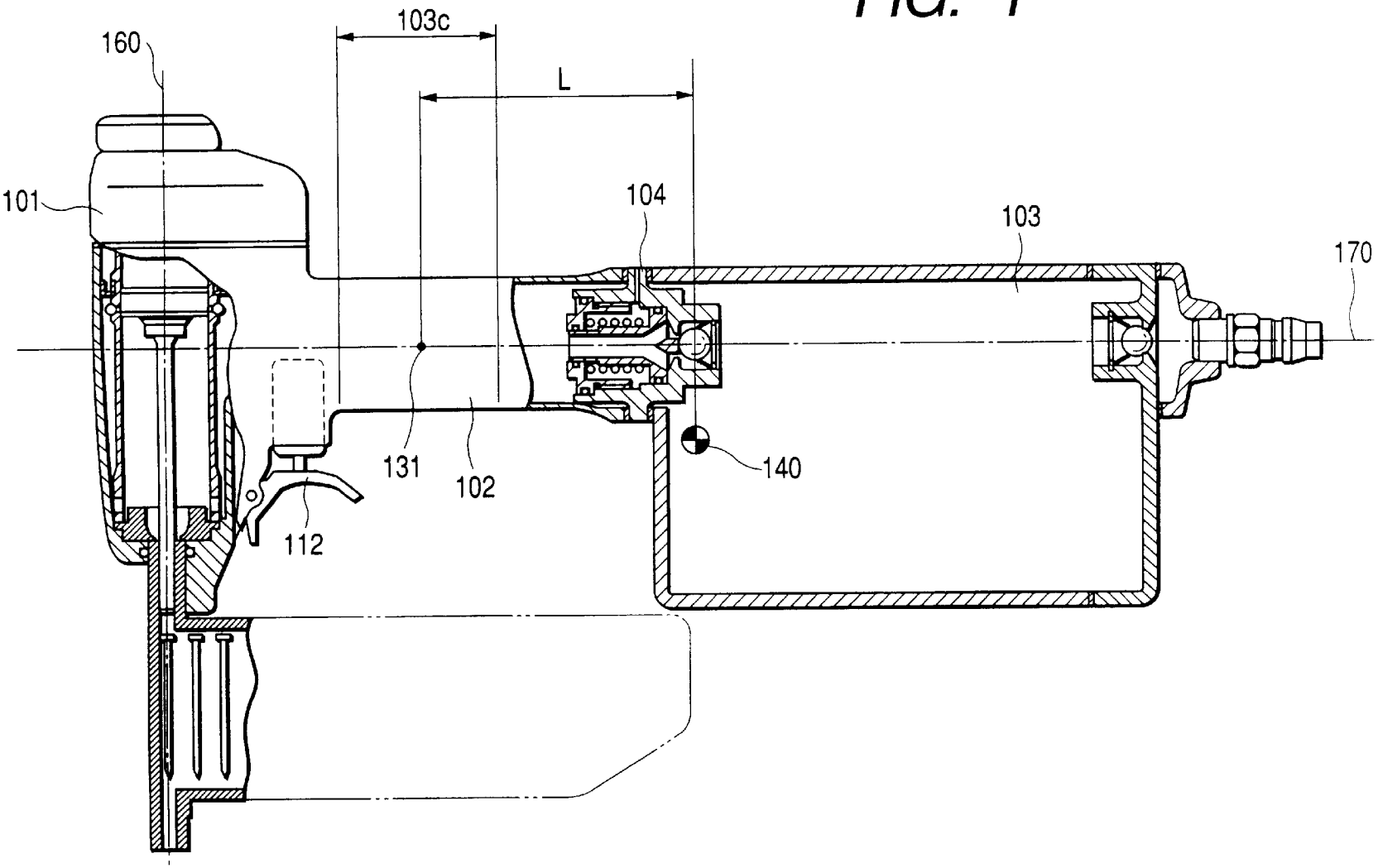
FIG. 1 is a side view showing an example of a possible hoseless driving tool.
Figure 2:
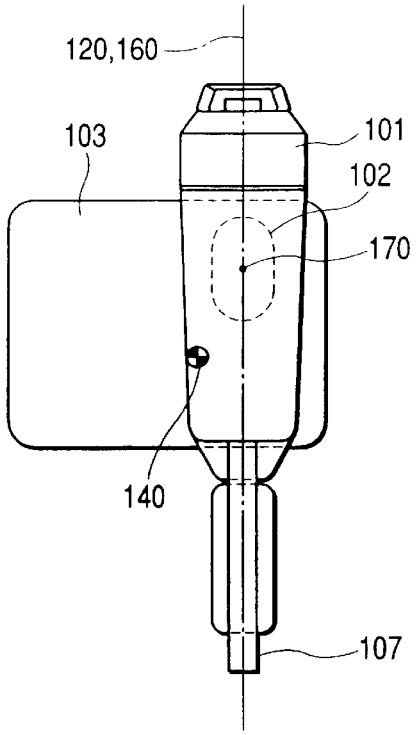
FIG. 2 is a front view showing another example of a hoseless driving tool.
Figure 3:
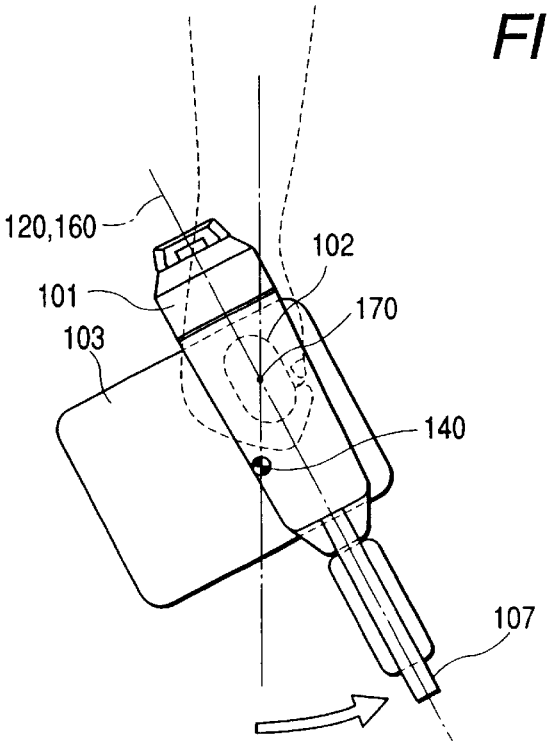
FIG. 3 is a front view showing a state where the hoseless driving tool of FIG. 2 is held.
Figure 4:
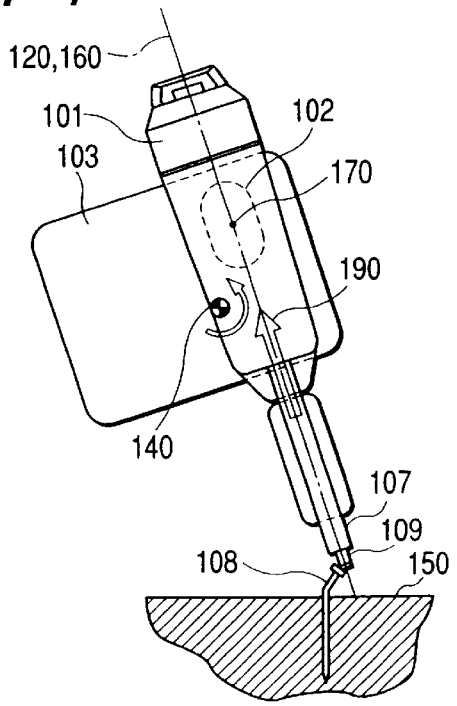
FIG. 4 is a front view showing a driving operation of the hoseless driving tool of FIG. 2.
Figure 5:
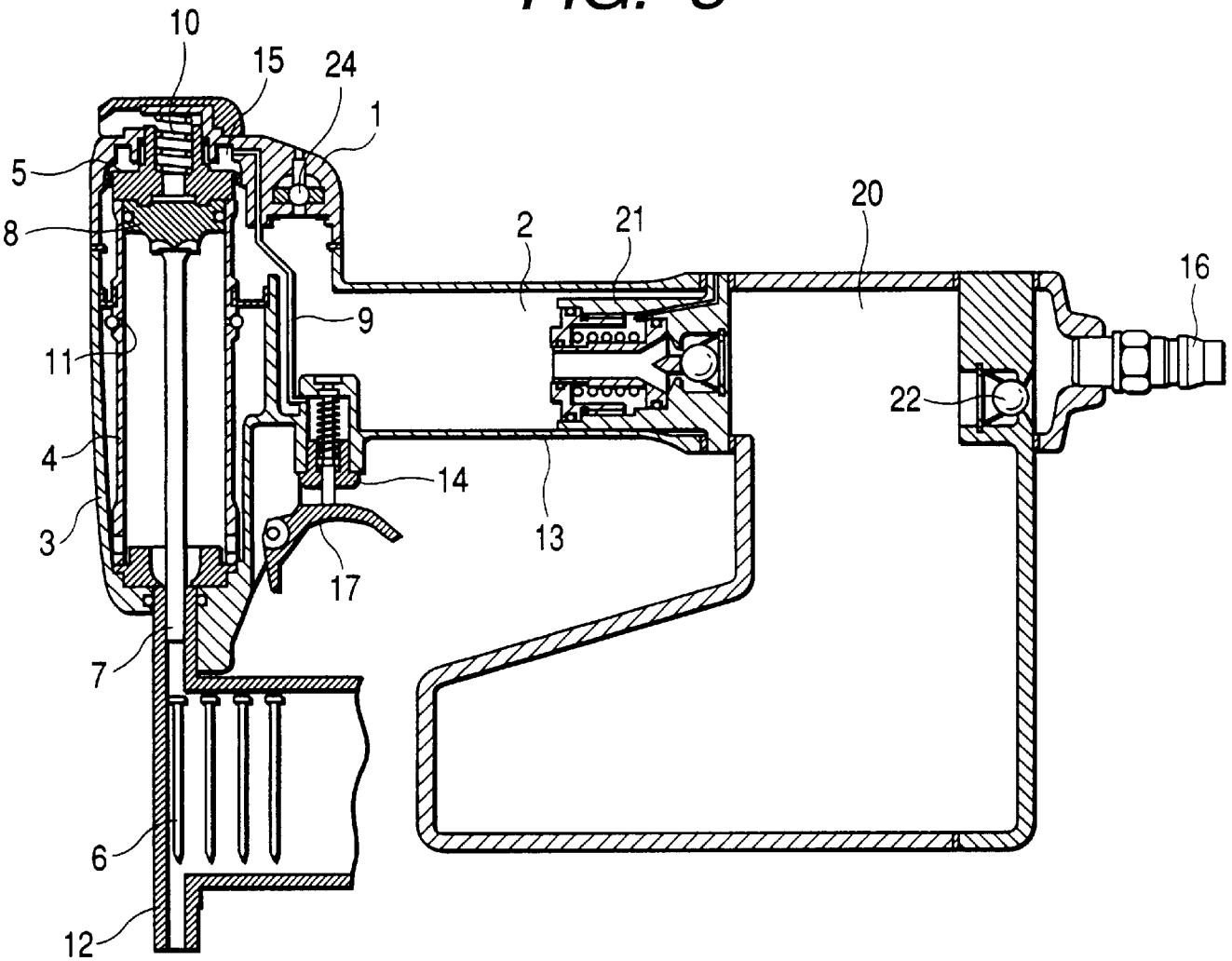
FIG. 5 is a side section view showing an example of a driving tool which has been proposed in a Japanese patent application by the assignee of the present invention.
Figure 6:
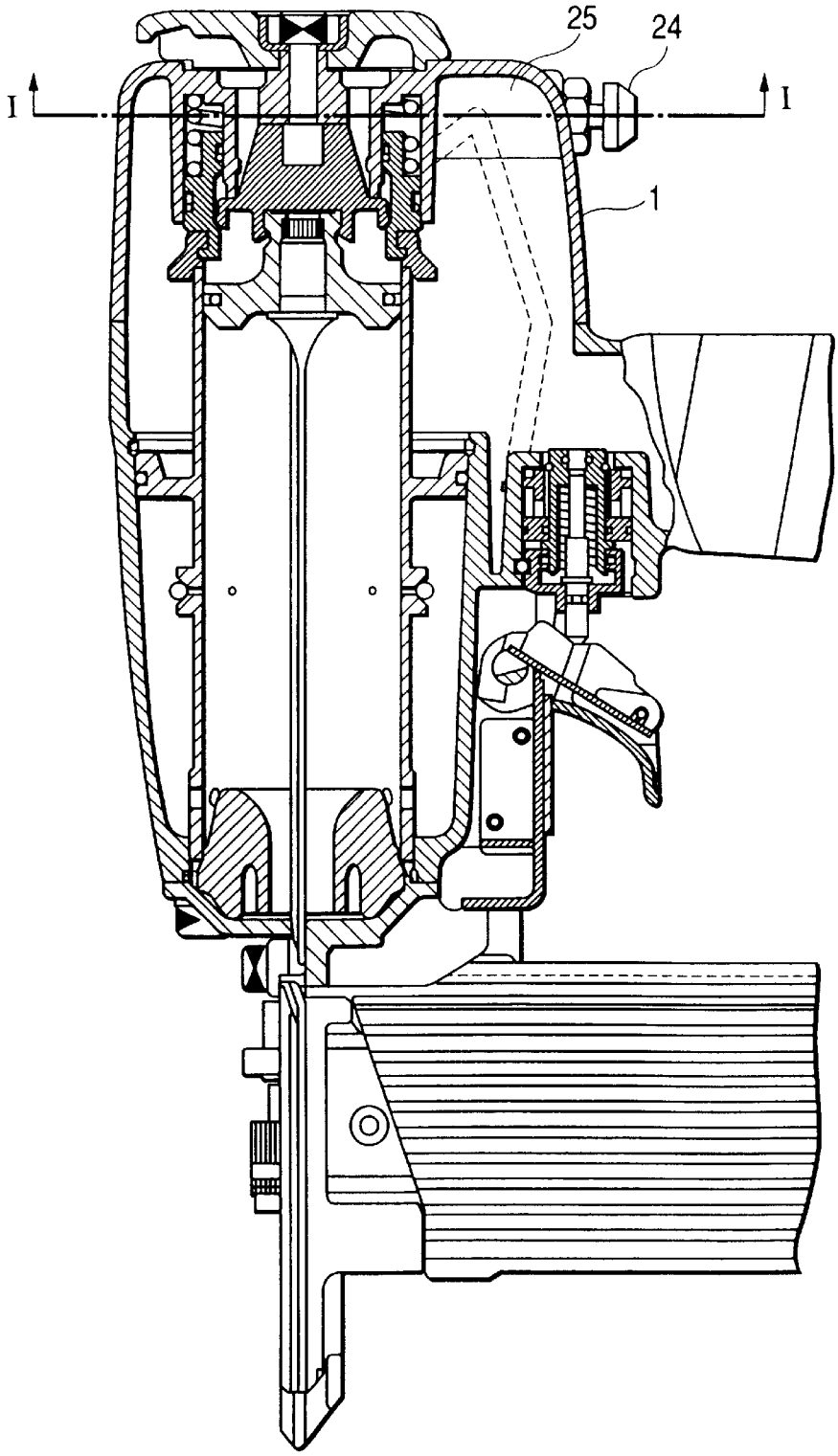
FIG. 6 is a side section view showing an example of a driving tool of the conventional art.
Figure 7:
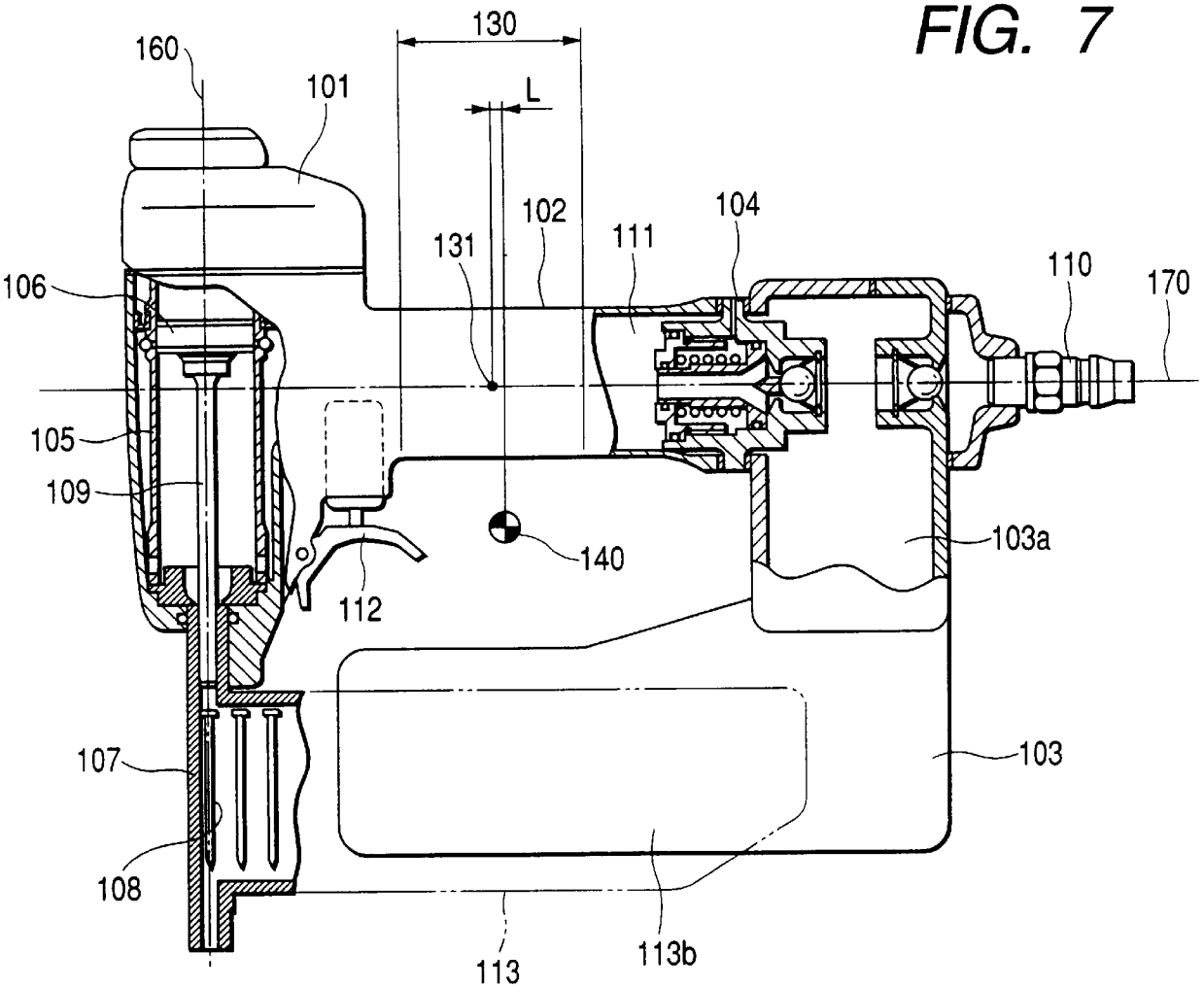
FIG. 7 is a side view showing an embodiment of the hoseless driving tool of the invention.

Now, a description will be given in more detail of preferred embodiments of the invention with reference to the figures.

A first embodiment of the invention will be described with reference to FIGS. 7 to 10.

The output section 101 has a substantially cylindrical appearance, and incorporates: a substantially cylindrical cylinder 105; a piston 106 which is movably disposed in the cylinder 105; a driver blade 109 which is coupled to a lower portion of the piston 106, and which strikes a fastener 108 held in a nose 107 below the output section 101, to drive the piece into a material to be fastened; and the like. The output section 101 is operated by compressed air stored in the handle section 102.

The handle section 102 has a cylindrical shape and is disposed so that the axis 170 of the section is substantially perpendicular to the axis 160 of the output section 101. The handle section 102 is hollowed, and an air passage 111 through which compressed air is supplied to the output section 101 is formed in the handle section. In the handle section 102, a trigger 112 which can be externally operated to control the operation of the output section 101 is disposed on the side of the output section 101. When a gripping portion 130 of the handle section 102 is gripped and the trigger 112 is operated, an operation of driving the fastener 108 is performed.

A pressure reducing valve 104 is disposed in a rear end portion of the handle section 102. The discharge side of the pressure reducing valve 104 communicates with the air passage 111 in the handle section 102, and the air intake side with the air tank 103, so that the high pressure compressed air in the air tank 103 is supplied to the output section 101 while the pressure is reduced to the working pressure of the output section 101.

Figure 8:
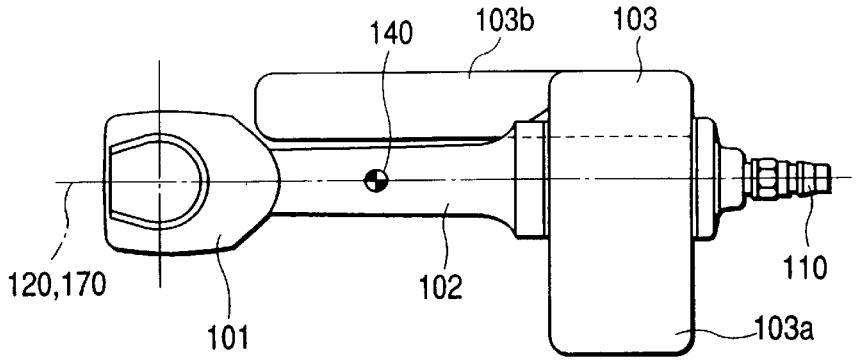
FIG. 8 is a plan view of FIG. 7.

The air tank 103 is formed into a substantially L-like shape consisting of a vertical portion 103*a* and a horizontal portion 103*b* in FIG. 8. The vertical portion 103*a* is a main portion which provides most of the capacity of the air tank 103. The vertical portion is coupled to the rear end portion of the handle section 102 via the pressure reducing valve 104, and protrudes in the rear side of the handle section 102. The protrusion distance and the weight of the vertical portion 103*a* are set so that the moment of gravity on the side of the output section 101 and acting on the gripping portion 130 of the handle section 102 is substantially equal to that on the side opposite to the output section and acting on the gripping portion 130 of the handle section 102.

Figure 9:
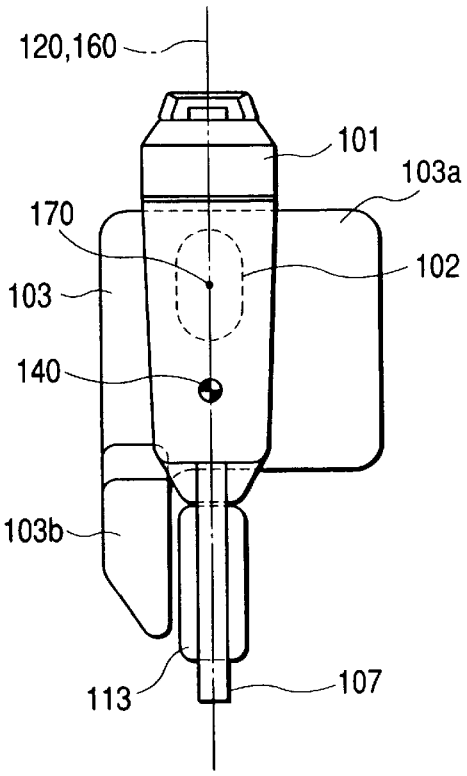
FIG. 9 is a front view of FIG. 7.

The vertical portion 103*a* is placed so that the right side with respect to the plane 120 in FIG. 9 is larger than the left side. The sizes of the right and left sides are set in the following manner. The moment of gravity of the members on the left side of the plane 120 in FIG. 9 (the air tank horizontal portion 103*b*, and a part of each of the air tank vertical portion 103*a*, the pressure reducing valve 104, the handle section 102, and the output section 101) with respect to the axis 170 of the handle section 102 is substantially equal to that of the members on the right side of the plane 120 (the other part of each of the air tank vertical portion 103*a*, the pressure reducing valve 104, the handle section 102, and the output section 101).

By contrast, the horizontal portion 103*b* is configured in order to make the vertical portion 103*a* compact and shorten the total length of the tool body while ensuring the capacity of the air tank 103. The horizontal portion 103*b* has an elongated appearance which extends in substantially parallel with the handle section 102. The horizontal portion elongates toward the output section 101 along the handle section 102 and a magazine 113. The horizontal portion 103*b* is disposed only on the left side of the plane 120 including the axis 170 of the handle section 102 and the axis 160 of an output section 101, in FIG. 9. This configuration is employed in order to enable one of the side faces of the magazine 113 to be opened so as to facilitate operations on the magazine 113, such as loading of fasteners 108.

In the above configuration, the output section 101 and the vertical portion 103*a* of the air tank 103 which are heavy are respectively disposed on both the sides of the handle section 102, and the movement of gravity acting on the side of the output section 101 and on the gripping portion 130 of the handle section 102 is set to be substantially equal to that on the side of the vertical portion 103*a* and acting on the gripping portion 130 of the handle section 102, and therefore, the center of gravity 140 of the whole of the driving tool is positioned in the vicinity of the gripping portion 130 of the handle section 102. As a result, the distance L between the center 131 of the gripping portion 130 and the center of gravity 140 is short, and the moment M•L (where M is the weight of the tool body) acting on the hand is reduced, so that the weight balance is improved and the driving tool can be easily operated. In other words, only a small force is required for holding the driving tool in the direction to the target. Since the movement of gravity of the members on the left side of the plane 1120 with respect to the axis 170 of the handle section 102 is set to be substantially equal to that of members on the right side of the plane 120, the center of gravity 140 of the whole of the driving tool is positioned in the vicinity of the plane 120. According to this configuration, when the body is lifted by gripping the handle section 102, the body turns only by a small degree because the center of gravity 140 is originally positioned vertically below the handle section 102, thereby facilitating the positioning of the nose 107. Since the center of gravity 140 is positioned in the direction of a reaction during a driving operation, i.e., in the direction of the axis 160 of the output section 101, the turning about the center of gravity of the body and due to the reaction is performed at a small amount. Therefore, a case where the body is tilted and the fastener 108 is driven while being bent or the driver blade 109 is disengaged from the fastener 108 and strikes the material to be fastened, less damage to the material occurs. In the above, the vicinity means approximately a region where, when the handle section 102 is gripped by a hand, the palm of the hand exists.

Figure 10:
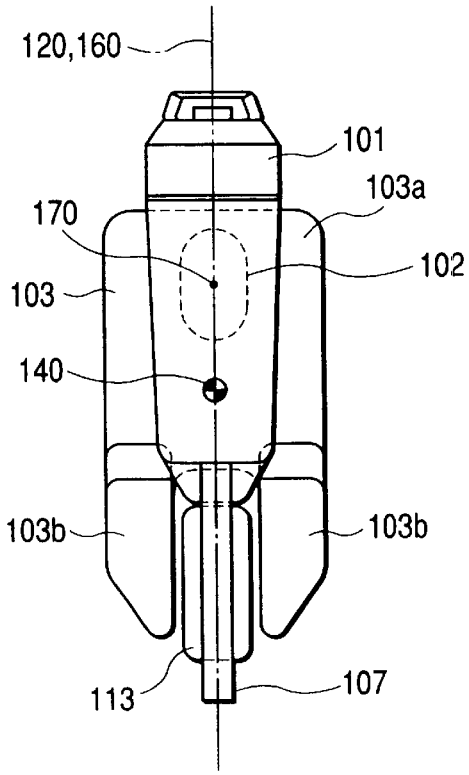
FIG. 10 is a front view showing another embodiment of the hoseless driving tool of the invention.

FIG. 10 shows a modified embodiment of the invention. Depending on the shape of the magazine 113, the horizontal portion 103*b* of the air tank 103 may be disposed so as to be symmetrical about the axis 170. In this case, when.also the vertical portion 103*a* is disposed so as to be symmetrical about the axis 170, the center of gravity 140 can be positioned in the vicinity of the plane 120.

Subsequently, a second embodiment of the invention will be described with reference to FIGS. 11 to 16.

In the rear of a handle portion 13 of the tool body 1, a second accumulator chamber 20 which communicates with a first accumulator chamber 2, and an air intake 16 which can be connected with an air compressor via an air hose 50 are disposed. A pressure reducing valve 21 is placed between the first accumulator chamber 2 and the second accumulator chamber 20, and a check valve 22 for preventing compressed air in the second accumulator chamber 20 from flowing out toward the air intake 16 is disposed between the second accumulator chamber 20 and the air intake 16. The first accumulator chamber 2 and the second accumulator chamber 20 are coupled to each other through the pressure reducing valve 21 so that the compressed air in the second accumulator chamber 20 is introduced into the first accumulator chamber 2 with reducing the pressure of the compressed air.

Figure 12:
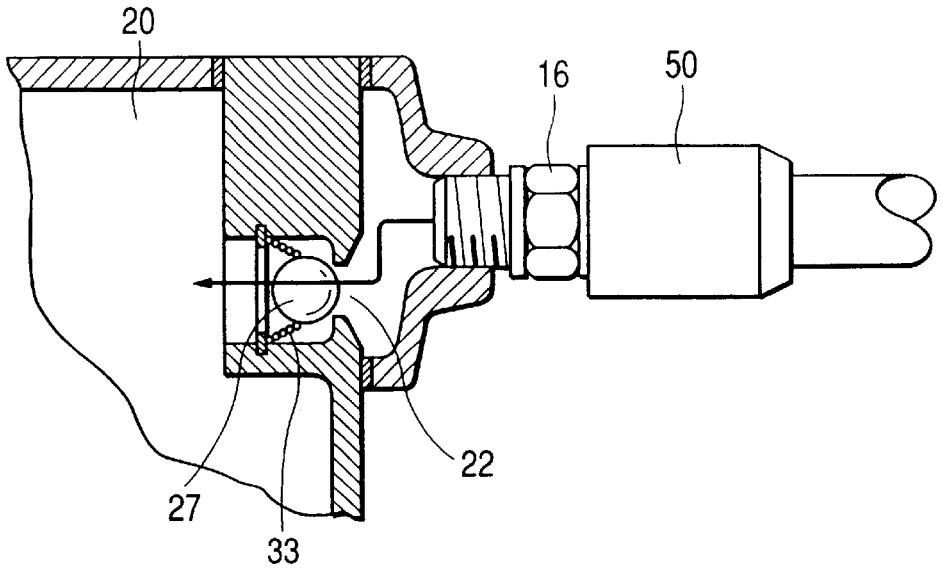
FIG. 12 is an enlarged view of main portions of FIG. 11.

As shown in FIG. 12, the check valve 22 disposed between the second accumulator chamber 20 and the air intake 16 is configured by an urethane ball 27 serving as a valve element, and a spring 33 which backward urges the urethane ball 27 so that the check valve 22 is normally in the closed position. When the pressure of the air intake 16 is higher than that of the second accumulator chamber 20, the urethane ball 27 is moved toward the second accumulator chamber 20 against the urging force of the spring 33, to set the check valve 22 to an opened state, whereby compressed air is supplied from the air compressor into the second accumulator chamber 20 via the air intake 16 and the check valve 22. By contrast, when the pressure of the second accumulator chamber 20 is higher than or substantially equal to that of the air intake 16, the check valve 22 is in the closed state, so that the compressed air does not enter the second accumulator chamber 20 through the air intake 16 and the compressed air in the second accumulator chamber 20 does not flow out to the air intake 16.

A case where the air hose 50 which is connected with the air compressor is connected with the air intake 16 will be described.

As described above, the compressed air from the air compressor is supplied into the second accumulator chamber 20 by the function of the check valve 22 until the pressure of the second accumulator chamber 20 becomes higher than that of the air intake 16. The compressed air accumulated in the second accumulator chamber 20 is then supplied into the first accumulator chamber 2 via the pressure reducing valve 21 disposed between the first accumulator chamber 2 and the second accumulator chamber 20.

Figure 13:
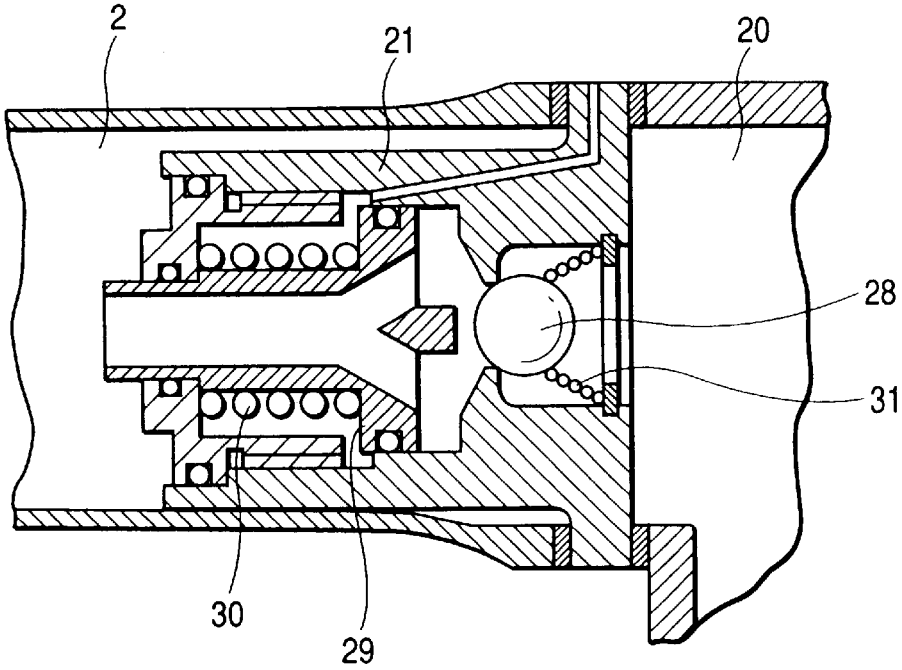
FIG. 13 is an enlarged view of main portions of FIG. 11.
Figure 14:
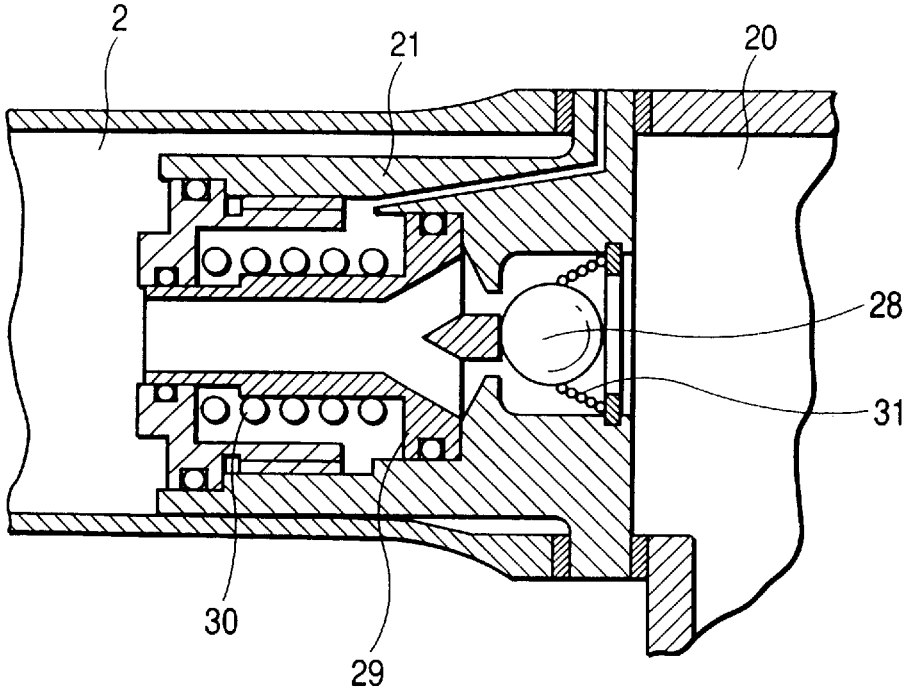
FIG. 14 is an enlarged view of main portions and showing an operation state of a pressure reducing valve shown in FIG. 13.

As shown in FIGS. 13 and 14, the pressure reducing valve 21 is configured by: an urethane ball 28 which makes and breaks communication between the first accumulator chamber 2 and the second accumulator chamber 20; a spring 31 which always forward urges the urethane ball 28 so as to break communication between the first accumulator chamber 2 and the second accumulator chamber 20; a regulator piston 29 which is slidably disposed to control the urethane ball 28; and a spring 30 which backward urges the regulator piston 29. The regulator piston 29 is always urged by the spring 30 so as to be moved toward the urethane ball 28, and forward urged by the compressed air in the first accumulator chamber 2 so as to be separated from the urethane ball 28.

In the pressure reducing valve 21 shown in FIG. 13, the regulator piston 29 is positioned in the left side in the figure against the urging force of the spring 30, and in the state where communication between the first accumulator chamber 2 and the second accumulator chamber 20 is broken. At this time, the interior of the first accumulator chamber 2 is at the maximum pressure (in that embodiment, 8 kg/cm$^2$). The valve is configured so that, when the pressure of the first accumulator chamber 2 is in the vicinity of the maximum pressure, the regular piston 29 slides so as to be separated from the urethane ball 28 against the urging force of the spring 30.

When the driving tool performs the driving operation and the pressure of the first accumulator chamber 2 is lowered, the urging force acting on the regulator piston 29 and due to the compressed air in the first accumulator chamber 2 becomes weaker than that of the spring 30, and the regulator piston 29 slides toward the urethane ball 28. As shown in FIG. 14, as a result, an end portion of the regulator piston 29 abuts against the urethane ball 28 to backward move the urethane ball 28 against the urging force of the spring 31, thereby causing the first accumulator chamber 2 to communicate with the second accumulator chamber 20.

The compressed air in the second accumulator chamber 20 is then supplied into the first accumulator chamber 2 via the pressure reducing valve 21, to raise the pressure of the first accumulator chamber 2. When the pressure of the first accumulator chamber reaches the maximum pressure, the regulator piston 29 again operates so that the pressure reducing valve 21 breaks the communication between the first accumulator chamber 2 and the second accumulator chamber 20.

In other words, when the pressure of the second accumulator chamber 20 serving as a compressed air supply source for the first accumulator chamber 2 is always higher than the maximum pressure of the first accumulator chamber 2, the pressure of the first accumulator chamber 2 is always maintained to the maximum pressure by the function of the pressure reducing valve 21.

First, a case in which a driving operation is performed in a state where the air hose 50 connected with the air compressor is connected with the air intake 16 will be described.

As described above, the interior of the first accumulator chamber 2 has the maximum pressure. When the driving tool is operated and the pressure of the first accumulator chamber 2 is lowered, the compressed air in the second accumulator chamber 20 is supplied into the first accumulator chamber 2 via the pressure reducing valve 21. This causes the pressure of the second accumulator chamber 20 to be lowered. Then, compressed air from the air compressor is supplied into the second accumulator chamber 20 via the air hose 50, the air intake 16, and the check valve 22, so that the pressure of the first accumulator chamber 2 is always maintained to the maximum pressure.

Next, a case in which a driving operation is performed while the air hose 50 is disconnected from the air intake 16 so that the connection between the driving tool and the air compressor is cancelled will be described.

As described above, the pressure of the second accumulator chamber 20 is higher than that of the first accumulator chamber 2. When the pressure of the first accumulator chamber 2 is lowered as a result of the driving operation performed by the driving tool, therefore, the compressed air in the second accumulator chamber 20 is supplied into the first accumulator chamber 2 via the pressure reducing valve 21, and the driving operation is continued while the compressed air is supplied until the pressure of the second accumulator chamber 20 reaches the maximum pressure of the first accumulator chamber 2. When the driving operation is further performed, the driving operation is performed while reducing the pressures of both the first accumulator chamber 2 and the second accumulator chamber 20.

When the driving operation is further performed and the pressure finally becomes lower than the working pressure, a sufficient output power cannot be obtained, and the operation of driving the fastener 6 is disabled. In this case, it is requested that the air hose 50 which is connected with the air compressor is again connected with the air intake 16, and the first accumulator chamber 2 and the second accumulator chamber 20 are refilled with compressed air.

In the driving tool of the invention, as described above, high pressure compressed air is stored in the second accumulator chamber 20, the compressed air is then supplied to the first accumulator chamber 2 while reducing the pressure of the compressed air by the pressure reducing valve 21, and the driving operation is performed by using the supplied compressed air as a power source. Therefore, the driving tool can attain an effect that, even when the air hose 50 is disconnected from the driving tool, the driving operation can be performed many times.

As described above, the driving operation can be performed many times in a state where the driving tool is once connected with the air compressor and then disconnected therefrom, or where the driving tool is connected with the air compressor as usual. Therefore, the range of the driving operation is free from restrictions due to the length of the air hose 50, the place where the air compressor is placed, and the like. As a result, the workability can be improved.

Figure 11:
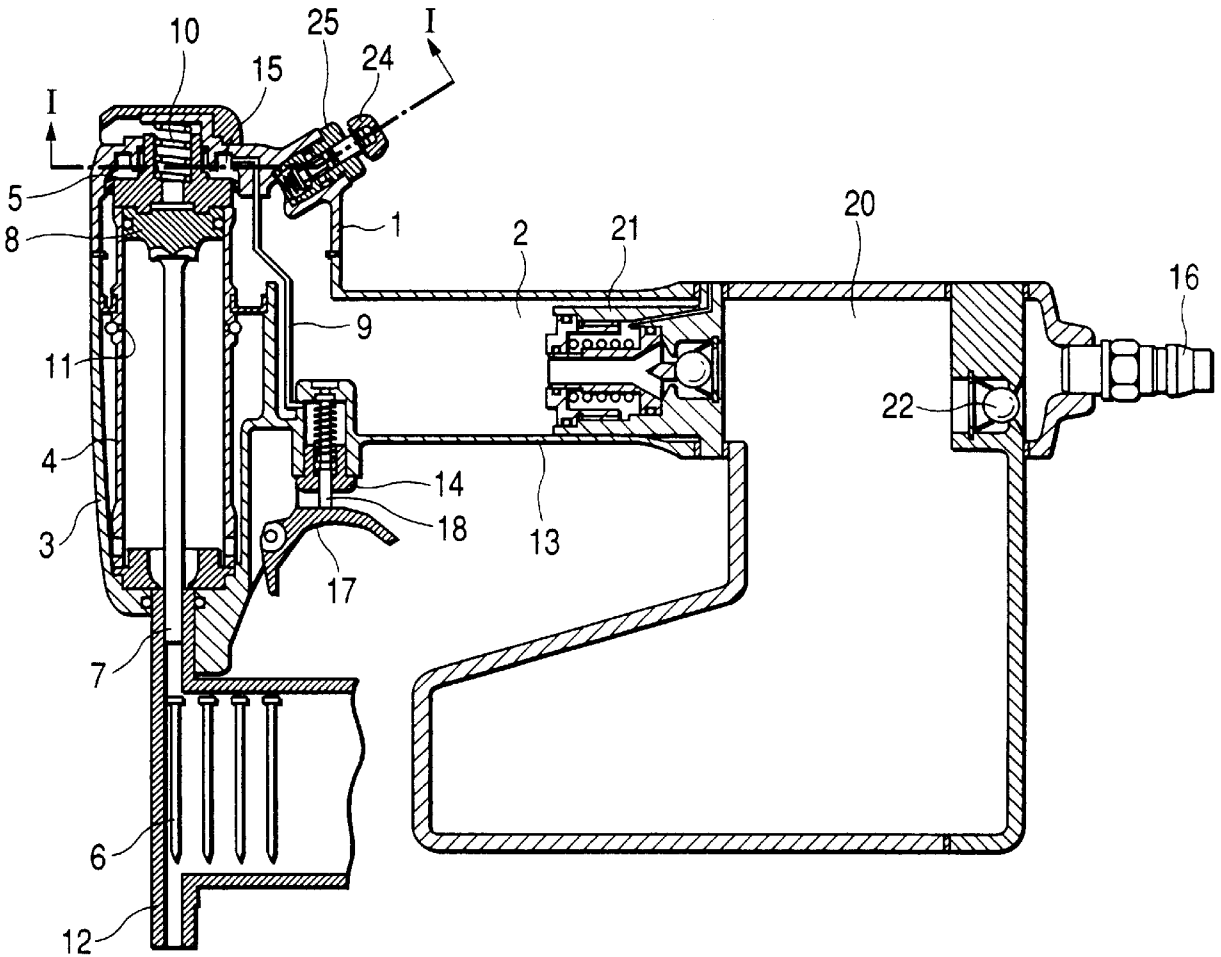
FIG. 11 is a side section view showing an embodiment of the driving tool of the invention.
Figure 15:
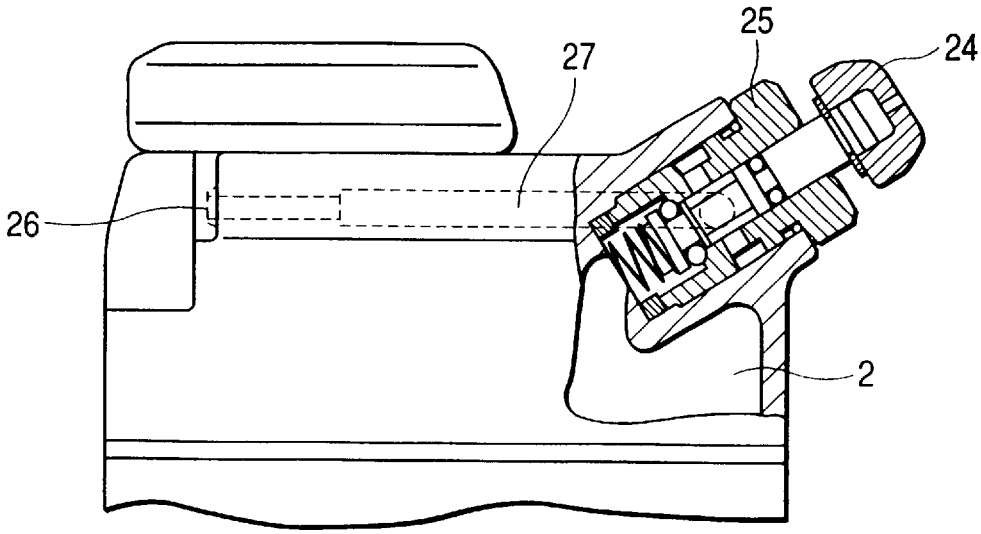
FIG. 15 is an enlarged view of main portions of FIG. 11.
Figure 16:
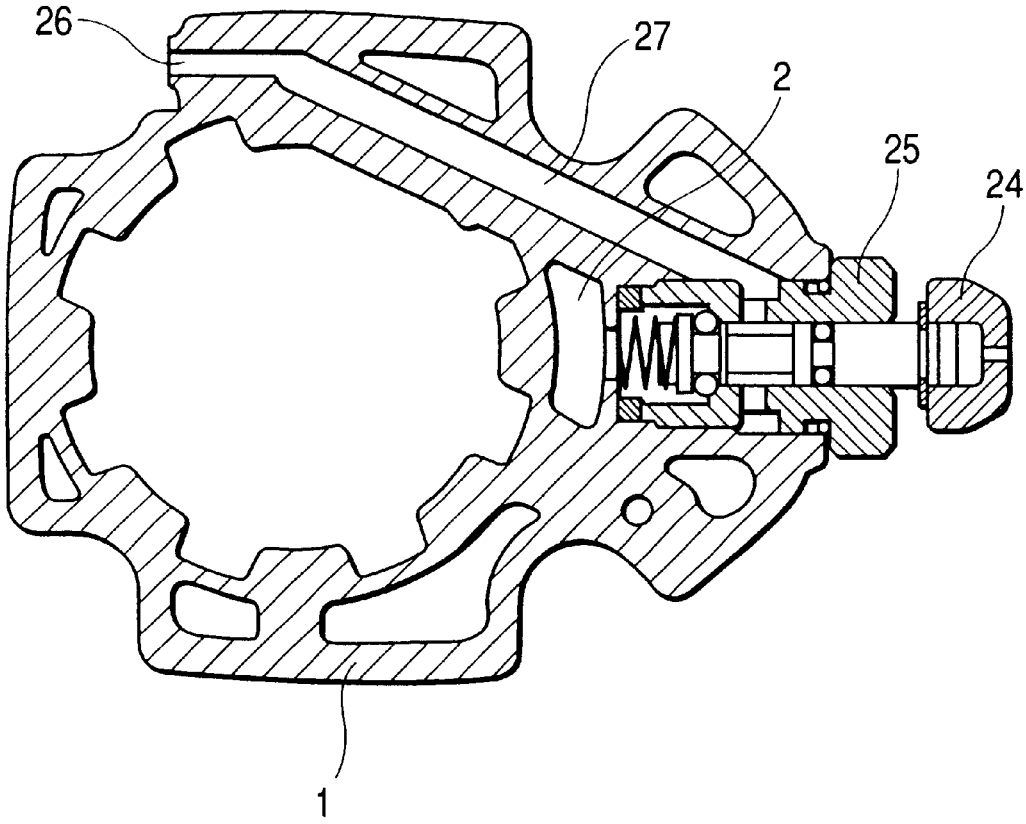
FIG. 16 is a section view taken along the line I—I of FIG. 11.

As shown in FIGS. 11, 15, and 16, an operating element 24 of a discharge valve 25 is disposed on the first accumulator chamber 2 of the tool body 1, so that, while holding the driving tool by one hand, the operating element can be operated by the thumb or the index finger of the hand holding the tool. A nozzle 26 is opened in a front portion of the tool body 1. The nozzle 26 communicates with the discharge valve 25 through an air passage 27, and the discharge valve 25 communicates with the first accumulator chamber 2.

Next, a dust removal operation by the thus configured air duster mechanism will be described.

First, the nozzle 26 is directed to a place where a cleaning work is to be performed. When the operating element 24 of the discharge valve 25 is then pushed by the hand holding the tool body, the compressed air stored in the first accumulator chamber 2 and the second accumulator chamber 20 is abruptly discharged via the air passage 27 from the opening at the tip end of the nozzle 26, thereby removing away dust, wood chips, and the like in the predetermined place.

In the same manner as the case of the driving operation described above, the driving tool can perform the cleaning work in a state where the driving tool is once connected with the air compressor and then disconnected therefrom, or where the driving tool is connected with the air compressor as usual. Therefore, the range of the work is free from restrictions due to the length of the air hose 50, the place where the air compressor is placed, and the like. As a result, the workability can be improved.

Next, a method of discharging the compressed air in the driving tool body 1 to the atmosphere when a work of driving fasteners such as nails is ended will be described.

In the same manner as the cleaning work described above, the discharge of the compressed air is performed by pushing the operating element 24 to open the discharge valve 25.

When the operating element 24 is pushed and the discharge valve 25 is opened, the first accumulator chamber 2 communicates with the atmosphere, and the compressed air in the first accumulator chamber 2 is then discharged to the atmosphere. When the pressure of the first accumulator chamber 2 is then lowered, the pressure reducing valve 21 operates so that the compressed air in the second accumulator chamber 20 flows into the first accumulator chamber 2. The discharge valve 25 is kept opened so that all the compressed air stored in the second accumulator chamber 20 is finally discharged to the atmosphere via the pressure reducing valve 21 and the first accumulator chamber 2.

A third embodiment of the invention will be described with reference to FIGS. 17 to 21.

Figure 17:
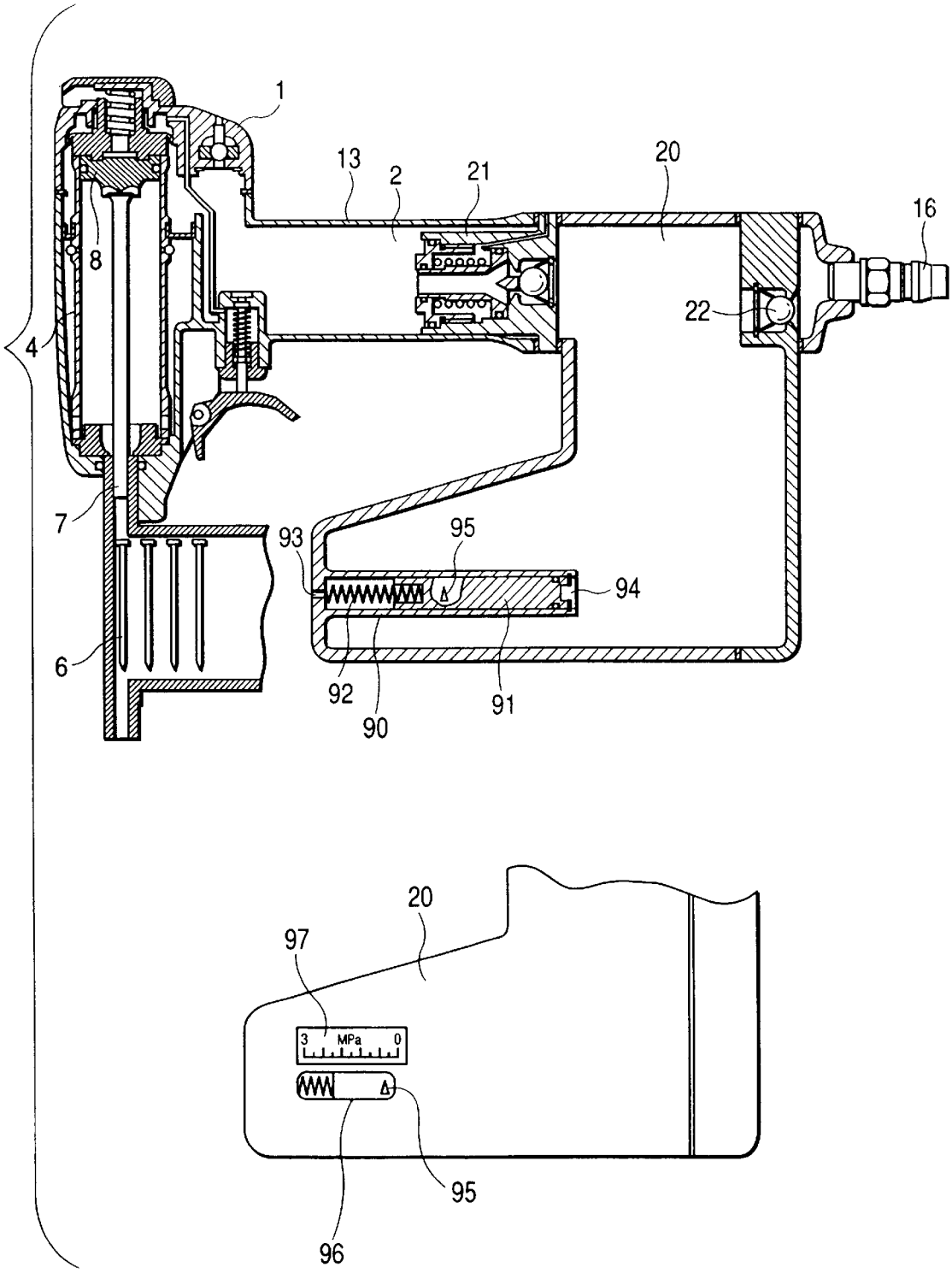
FIG. 17 is a side section view showing an embodiment of the driving tool of the invention.

As shown in FIG. 17, in the rear end of a handle portion 13 of the tool body 1, a second accumulator chamber 20 that communicates with a first accumulator chamber 2, and an air intake 16 which can be connected with an air compressor via an air hose 50 are disposed. A pressure reducing valve 21 is placed between the first accumulator chamber 2 and the second accumulator chamber 20, and a check valve 22 for preventing compressed air in the second accumulator chamber 20 from flowing out toward the air intake 16 is disposed between the second accumulator chamber 20 and the air intake 16.

In the first accumulator chamber 2, compressed air which is to be consumed in an operation of driving a fastener 6 is accumulated, and, in the second accumulator chamber 20, high pressure compressed air which is supplied from an air compressor is accumulated. The two accumulator chambers 2 and 20 are coupled to each other through the pressure reducing valve 21 so that the compressed air in the second accumulator chamber 20 is introduced into the first accumulator chamber 2 with reducing the pressure of the compressed air.

A pressure gauge 90 is disposed on the second accumulator chamber 20. The pressure gauge 90 is configured by a gauge piston 91 and a gauge spring 92. An end of the gauge piston 91 on the side of the gauge spring 92 communicates with the atmosphere through an air passage 93. The other end of the gauge piston 91 communicates with the interior of the second accumulator chamber 20 through an air passage 94. The gauge piston 91 stops at a position where a force caused by the pressure of the second accumulator chamber 20 balances with the urging force of the gauge spring 92. A mark 95 is formed on the gauge piston 91, and a window 96 is formed on the second accumulator chamber 20 so that the mark 95 can be seen from the outside. A scale 97 is formed in the vicinity of the window 96. When the gauge piston 91 is moved in accordance with the pressure of the second accumulator chamber 20, also the mark 95 is moved. The pressure of the second accumulator chamber 20 can be known by reading the value of the scale 97 which is indicated by the mark 95. In the thus configured pressure gauge, parts have higher strength, and the resistance to vibration is more excellent as compared with a usual gauge which uses a Bourdon tube. Therefore, the pressure gauge is particularly suitable for attachment to a driving tool to which vibrations are repeatedly applied. Furthermore, the pressure gauge has a reduced number of parts, and hence can be made compact.

A case in which the air hose 50 connected with the air compressor is connected with the air intake 16 will be described. As described above, the compressed air from the air compressor is supplied into the second accumulator chamber 20 by the function of the check valve 22 until the pressure of the second accumulator chamber 20 becomes equivalent to that of the air intake 16. In this case, as the pressure of the second accumulator chamber 20 becomes higher, the compressed air exerts a larger pushing force on the gauge piston 91, so that the gauge piston 91 is moved in the leftward direction in FIG. 17 against the urging force of the gauge spring 92. By reading the value of the scale 97 which is indicated by the mark 95, it is known that compressed air has been accumulated in the second accumulator chamber 20. The compressed air accumulated in the second accumulator chamber 20 is supplied into the first accumulator chamber 2 via the pressure reducing valve 21 which is disposed between the first accumulator chamber 2 and the second accumulator chamber 20.

Figure 18:
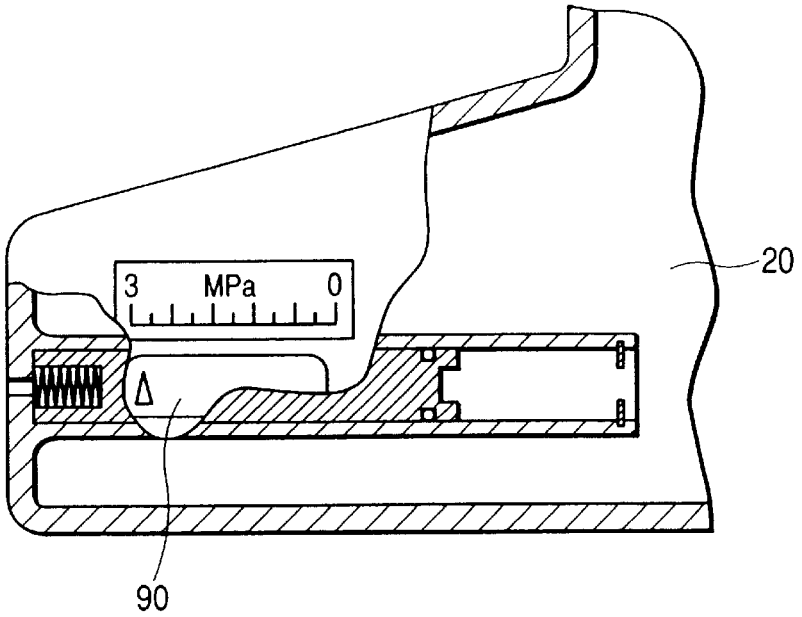
FIG. 18 is an enlarged view of main portions showing an operation state of a pressure gauge.

Next, the operation of the driving tool of the invention will be described. A case in which a driving operation is performed in a state where the air hose 50 connected with the air compressor is connected with the air intake 16 will be described. As described above, the interior of the second accumulator chamber 20 and that of the first accumulator chamber 2 have the maximum pressure. When the driving tool is operated and the pressure of the first accumulator chamber 2 is lowered, the compressed air in the second accumulator chamber 20 is supplied into the first accumulator chamber 2 via the pressure reducing valve 21. This causes the pressure of the second accumulator chamber 20 to be lowered. Then, compressed air from the air compressor is supplied into the second accumulator chamber 20 via the air hose 50, the air intake 16, and the check valve 22, so that the first accumulator chamber 2 and the second accumulator chamber 20 are always maintained to the maximum pressure. The pressure gauge 90 indicates substantially always that the pressure of the second accumulator chamber 20 is maximum (FIG. 18).

Next, a case in which a driving operation is performed while the air hose 50 is disconnected from the air intake 16 so that the connection between the driving tool and the air compressor is cancelled will be described. It is assumed that the pressures of the first accumulator chamber 2 and the second accumulator chamber 20 are set to be maximum by the compressed air supplied from the air compressor. At this time, the pressure gauge 90 indicates that the second accumulator chamber has the maximum pressure (FIG. 18).

Figure 19:
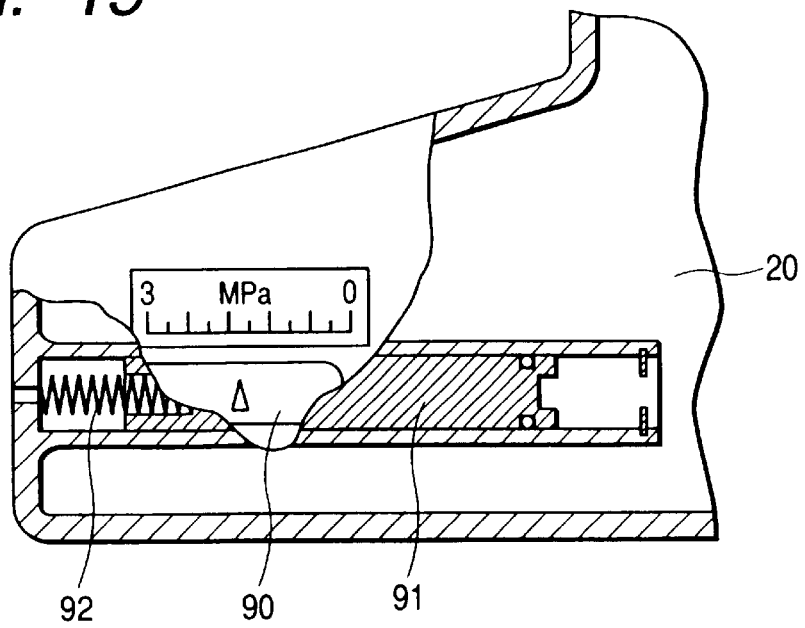
FIG. 19 is an enlarged view of main portions showing an operation state of the pressure gauge shown in FIG. 18.

As described above, the pressure of the second accumulator chamber 20 is higher than that of the first accumulator chamber 2. When the pressure of the first accumulator chamber 2 is lowered as a result of the driving operation performed by the driving tool, therefore, the compressed air in the second accumulator chamber 20 is supplied into the first accumulator chamber 2 via the pressure reducing valve 21. In accordance with the supply, the internal pressure of the second accumulator chamber 20 is gradually lowered. Then, the force at which the compressed air in the second accumulator chamber 20 pushes the gauge piston 91 is weakened, so that the gauge piston 91 is moved to a position where the pushing force balances with the urging force of the gauge spring 92. By reading the pressure gauge 90, the operator can check the manner in which the compressed air in the second accumulator chamber is consumed (FIG. 19).

When a driving operation is performed after the pressure of the second accumulator chamber 20 is lowered to the maximum pressure of the first accumulator chamber 2, the pressure of the first accumulator chamber 2 is lowered and the pressure reducing valve 21 is operated. Then, the compressed air in the second accumulator chamber 20 flows into the first accumulator chamber 2. Since the pressure of the first accumulator chamber 2 is equal to or lower than the maximum pressure, the pressure reducing valve 21 is always in a state where the two accumulator chambers 2 and 20 communicate with each other. When this state is attained, the pressures of the accumulator chambers 2 and 20 are simultaneously lowered each time when a driving operation is performed. When the pressures finally become lower than the working pressure, a sufficient output power cannot be obtained, and the operation of driving the fastener 6 is disabled.

When the pressure gauge 90 is checked, it is possible to know that the pressure of the second accumulator chamber 20 is lowered to the maximum pressure of the first accumulator chamber 2. Therefore, it is possible to predict that the driving operation will be disabled, and know that the driving tool enters a state where refilling must be performed. Therefore, a driving failure due to an insufficient pressure of the second accumulator chamber 20 is prevented from occurring. The air hose 50 which is connected with the air compressor is again connected with the air intake 16 to refill the first accumulator chamber 2 and the second accumulator chamber 20 with compressed air, thereby enabling the driving work to be continued.

When the driving work is ended, it is preferable to completely discharge the compressed air in the second accumulator chamber 20 in order to prevent the driving tool from being accidentally operated. When the pressure gauge 90 is checked, it is possible to check whether the second accumulator chamber 20 is completely empty or not.

Figure 20A:
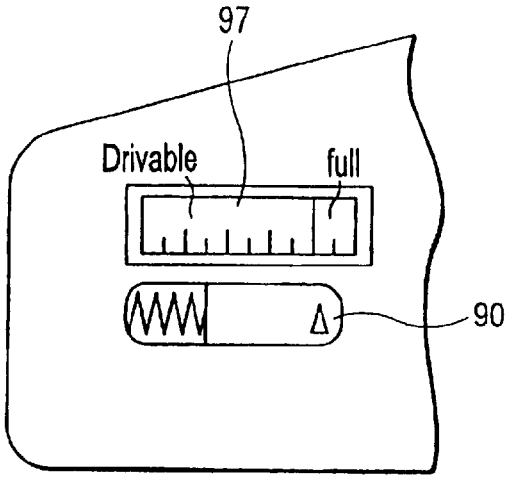
FIGS. 20A and 20B are enlarged section views showing main portions of a still further embodiment of the driving tool of the invention.
Figure 20B:
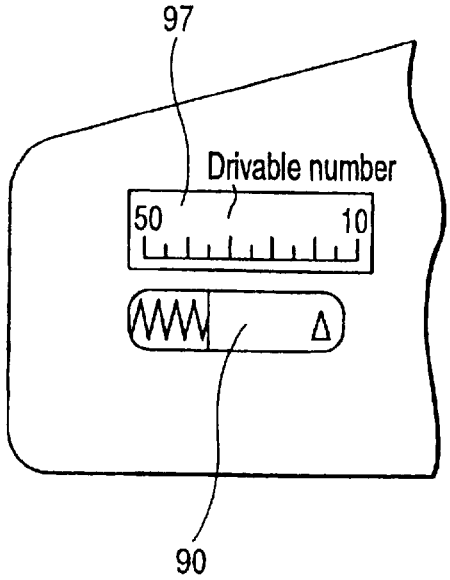

FIGS. 20A and 20B show other modified embodiments in which the scale 97 is displayed in another method. FIG. 20A shows a configuration which, in place of displaying a specific pressure value, indicates whether the tool body 1 can perform a driving operation or not, so that the state of the driving tool can be easily checked while working. FIG. 20B shows an example in which the pressure is displayed with being converted into an approximate number of possible driving operations. This example has a feature that the working amount can be specifically obtained.

Figure 21:
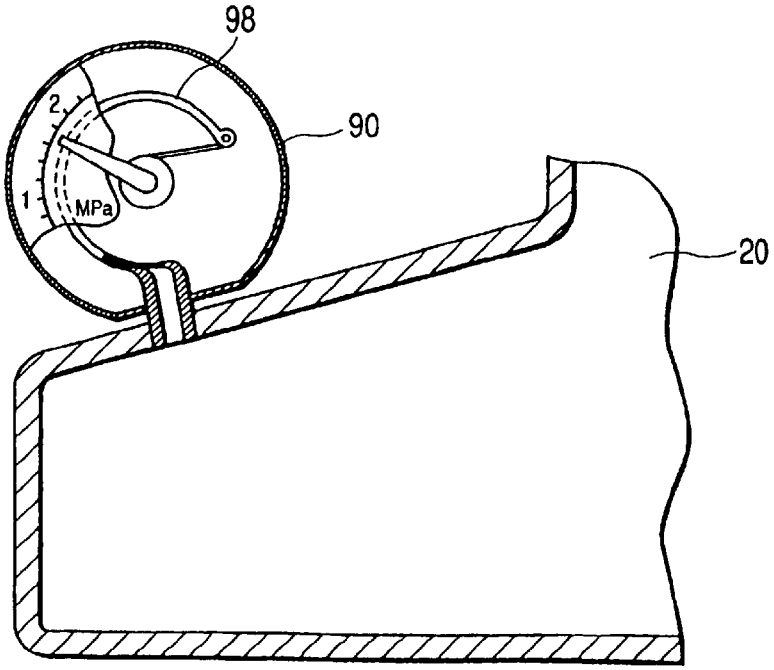
FIG. 21 is an enlarged section view showing main portions of a still further embodiment of the driving tool of the invention.

FIG. 21 shows an example in which a Bourdon tube 98 is used as the pressure gauge 90. The pressure gauge 90 may be configured in any manner as far as it can measure the pressure of the second accumulator chamber 20.

As was described above, the disposition of the pressure gauge 90 on the second accumulator chamber 20 enables the operator to predict that the driving operation will be disabled, and know that the driving tool enters a state where refilling must be performed. Therefore, a driving failure is prevented from occurring. When the number of fasteners which are to be driven is compared with the pressure of the second accumulator chamber 20, it is possible to predict whether refilling of compressed air must be performed before starting a driving work or not. Therefore, an extra refilling operation can be avoided.

According to the invention, in a hoseless driving tool to which an air tank is attached, the center of gravity of the whole tool is positioned in the vicinity of a gripping portion of a handle section, whereby the weight balance can be improved so as to enhance the workability. Furthermore, the dimensions of the hoseless driving tool can be reduced.

Also, as was described above, according to the invention, each of driving and cleaning works can be performed in either of the cases where the driving tool is connected with an air compressor, and where the connection with the air compressor is cancelled. Therefore, it is possible to provide a driving tool which can be used even in a state where the driving tool is not connected with an air compressor via an air hose or the like, to enhance the workability, and in which filling of compressed air can be easily performed.

The single valve is used as a discharge valve for discharging compressed air in the tool body to the atmosphere to empty the tool body, and also as that for a cleaning work by an air duster. Therefore, the structure is simplified. This contributes to the reduced weight and size of the driving tool, the reduced number of malfunctions, and the like.

After a driving work is ended, usually, the driving places and the work area are cleaned. Since the driving tool of the invention incorporates the function of an air duster, the incorporated air duster function can be used in the cleaning work. The single valve is used as a discharge valve for discharging compressed air in the tool body to empty the tool body, and also as that for a cleaning work by an air duster. During a cleaning work after a driving work is ended, therefore, the discharge valve is operated, and at this time the compressed air in the driving tool body can be discharged to the atmosphere. When the discharge valve is kept operated, it is possible to completely discharge the compressed air from the tool body. Consequently, the operation of the discharge valve after a driving work can be performed simultaneously with a cleaning work. As a result, it is possible to attain various effects such as that the cumbersome positive operation of the discharge valve can be eliminated, and that a case where it is forget to discharge compressed air in the tool body after the work occurs in a reduced number of times.

Further, as was described above, according to the invention, since the second accumulator chamber is provided with a pressure gauge, the amount of compressed air in the second accumulator chamber can be easily known without performing a driving operation. Therefore, a driving failure due to an insufficient pressure of the second accumulator chamber can be prevented from occurring and it is possible to easily check whether the second accumulator chamber is empty or not.

What is claimed is:

1. A hoseless driving tool comprising:

an output section which is configured by a cylinder, a piston that is movably disposed in said cylinder, and a driver blade that is attached to said piston, said piston and driver blade being driven by compressed air that is supplied into said cylinder;

a handle section which is disposed substantially perpendicularly to said output section;

an air tank which stores compressed air at a pressure that is higher than a pressure at which said output section is operable; and a pressure reducing valve which supplies the compressed air in said air tank to said output section while reducing the pressure of the compressed air to the pressure at which said output section is operable;

wherein said air tank is disposed behind said handle section, so as to be provided at an end of said handle section which is opposite to an end of said handle section which faces said output section, whereby a center of gravity of a whole of said tool is positioned in a vicinity of a gripping portion of said handle section, wherein said air tank is a second accumulator chamber, and wherein said pressure reducing valve supplies the compressed air from said second accumulator chamber to a first accumulator chamber so that the compressed air in the second accumulator chamber is introduced into the first accumulator chamber while reducing the pressure of the compressed air.

2. A hoseless driving tool according to claim 1, wherein said handle section has a longitudinal axis which is disposed substantially perpendicular to a longitudinal axis of said output section, and wherein a front of the handle section is disposed adjacent to the output section and a rear of the handle section is disposed adjacent to the pressure reducing valve, and wherein said air tank is attached to said rear of the handle section so as to be disposed only behind said rear of the handle section as viewed along said longitudinal axis of said handle section.

3. A hoseless driving tool comprising:

an output section which is configured by a cylinder, a piston that is movably disposed in said cylinder, and a driver blade that is attached to said piston, said piston and driver blade being driven by compressed air that is supplied into said cylinder;

a handle section which is disposed substantially perpendicularly to said output section;

an air tank which stores compressed air at a pressure that is higher than a pressure at which said output section is operable; and a pressure reducing valve which supplies the compressed air in said air tank to said output section while reducing the pressure of the compressed air to the pressure at which said output section is operable;

wherein said air tank and said pressure reducing valve are positioned so that, with respect to two regions which are separated from each other by a plane including axes of said handle section and said output section, a moment of gravity of a member(s) which is on a side of the axis of said handle section is substantially equal to a moment of gravity of a member(s) which is on another side of the axis, whereby a center of gravity of a whole of said tool is positioned in a vicinity of the plane, and wherein said air tank is disposed behind said handle section, so as to be provided at an end of said handle section which is opposite to an end of said handle section which faces said output section, wherein said air tank is a second accumulator chamber, and wherein said pressure reducing valve supplies the compressed air from said second accumulator chamber to a first accumulator chamber so that the compressed air in the second accumulator chamber is introduced into the first accumulator chamber while reducing the pressure of the compressed air.

4. A hoseless driving tool, comprising:

an output section which is configured by a cylinder, a piston that is movably disposed in said cylinder, and a driver blade that is attached to said piston, said piston and driver blade being driven by compressed air that is supplied into said cylinder;

a handle section which is disposed substantially perpendicularly to said output section;

an air tank which stores compressed air at a pressure that is higher than a pressure at which said output section is operable; and a pressure reducing valve which supplies the compressed air in said air tank to said output section while reducing the pressure of the compressed air to the pressure at which said output section is operable;

wherein said air tank is disposed behind said handle section, whereby a center of gravity of a whole of said tool is positioned in a vicinity of a gripping portion of said handle section, wherein a width of said air tank is larger than a width of said handle section, and said air tank is configured by a vertical portion which extends vertically downward, and a horizontal portion which extends from a lower part of said vertical portion toward said output section in substantially parallel with said handle section.

5. A driving tool comprising:

a first accumulator chamber which is disposed in a tool body;

a second accumulator chamber in which compressed air can be accumulated, a pressure of the compressed air being higher than a pressure at which said tool body is operable;

an air intake which is connectable with an air compressor via a means for conveying;

a communication control valve which controls communication between said second accumulator chamber and said air intake; and a pressure reducing valve through which the compressed air in said second accumulator chamber is supplied to said first accumulator chamber while reducing the pressure of the compressed air, a piston which is disposed in a cylinder to be vertically movable being driven by the compressed air in said first accumulator chamber, a fastener being driven by a drive bit attached to said piston;

wherein a nozzle having an opening through which the compressed air is to be discharged, an air passage through which said nozzle communicates with said first accumulator chamber or said second accumulator chamber, and a discharge valve which controls discharging of the compressed air from said nozzle are operably disposed.

6. A driving tool according to claim 5, wherein a member having said second accumulator chamber, said air intake, said communication control valve, and said pressure reducing valve is disposed independently from said tool body, said member being detachable with respect to said tool body.

7. A driving tool according to claim 5, wherein said pressure reducing valve is disposed in said tool body, and a member having said second accumulator chamber, said air intake, and said communication control valve is disposed independently from said tool body, said member being detachable with respect to said tool body.

8. A driving tool according to claim 5, wherein said communication control valve is a check valve which functions to prevent the compressed air in said second accumulator chamber from flowing out through said air intake.

9. A driving tool comprising:

a first accumulator chamber which is disposed in a tool body;

a second accumulator chamber in which compressed air can be accumulated, a pressure of the compressed air being higher than a pressure at which said tool body is operable;

an air intake which is connectable with an air compressor via an air hose or the like;

a communication control valve which controls communication between said second accumulator chamber and said air intake; and a pressure reducing valve through which the compressed air in said second accumulator chamber is supplied to said first accumulator chamber with reducing the pressure of the compressed air, a piston which is disposed in a cylinder to be vertically movable being driven by the compressed air in said first accumulator chamber, a fastener being driven by a drive bit attached to said piston;

wherein a pressure gauge which measures the pressure of said second accumulator chamber is disposed.

10. A driving tool according to claim 9, wherein a member having said second accumulator chamber, said air intake, said communication control valve, and said pressure reducing valve is disposed independently from said tool body, said member being detachable with respect to said tool body.

11. A driving tool according to claim 9, wherein said pressure reducing valve is disposed in said tool body, and a member having said second accumulator chamber, said air intake, and said communication control valve is disposed independently from said tool body, said member being detachable with respect to said tool body.

12. A driving tool according to claim 9, wherein said pressure reducing valve, said air intake, and said communication control valve are disposed in said tool body, and said second accumulator chamber is disposed independently from said tool body, said second accumulator chamber being detachable with respect to said tool body.

13. A driving tool according to claim 9, wherein said communication control valve is a check valve which functions to prevent the compressed air in said second accumulator chamber from flowing out through said air intake.

14. A driving tool according to claim 9, wherein said pressure gauge is configured by a gauge piston, and elastic means for urging said gauge piston, and measures a pressure by causing a side of said gauge piston opposite to said elastic means to communicate with said second accumulator chamber, and to stop said gauge piston at a position where an urging force due to said elastic means balances with an urging force due to the compressed air in said second accumulator chamber.

15. A hoseless driving tool comprising:

an output section which is configured by a cylinder, a piston that is movably disposed in said cylinder, and a driver blade that is attached to said piston, said piston and driver blade being driven by compressed air that is supplied into said cylinder;

a handle section which is disposed substantially perpendicularly to said output section; and an air tank which stores compressed air at a pressure that is higher than a pressure at which said output section is operable; and a pressure reducing valve which supplies the compressed air in said air tank to said output section while reducing the pressure of the compressed air to the pressure at which said output section is operable;

wherein said air tank is coupled to said handle section via the pressure reducing valve; and wherein said air tank is disposed behind said handle section, so as to be provided at an end of said handle section which is opposite to an end of said handle section which faces said output section, whereby a center of gravity of a whole of said tool is positioned in a vicinity of a gripping portion of said handle section.

16. A hoseless driving tool comprising:

an output section which is configured by a cylinder, a piston that is movably disposed in said cylinder, and a driver blade that is attached to said piston, said piston and driver blade being driven by compressed air that is supplied into said cylinder;

a handle section which is disposed substantially perpendicularly to said output section;

an air tank which stores compressed air at a pressure that is higher than a pressure at which said output section is operable; and a pressure reducing valve which supplies the compressed air in said air tank to said output section while reducing the pressure of the compressed air to the pressure at which said output section is operable;

wherein said air tank is coupled to said handle section via the pressure reducing valve; and wherein said air tank and said pressure reducing valve are positioned so that, with respect to two regions which are separated from each other by a plane including axes of said handle section and said output section, a moment of gravity of a member(s) which is on a side of the axis of said handle section is substantially equal to a moment of gravity of a member(s) which is on another side of the axis, whereby a center of gravity of a whole of said tool is positioned in a vicinity of the plane, wherein said air tank is disposed behind said handle section, so as to be provided at an end of said handle section which is opposite to an end of said handle section which faces said output section.

* * * * *